US005297510A

United States Patent [19]

Turkowski

[11] Patent Number: 5,297,510

[45] Date of Patent: Mar. 29, 1994

[54] VOLUME IGNITION SYSTEM

[75] Inventor: Wojciech M. Turkowski, 10000 Rosensteel Ave., Silver Spring, Md. 20910

[73] Assignee: Wojciech M. Turkowski, Silver Spring, Md.

[21] Appl. No.: 698,829

[22] Filed: Apr. 26, 1991

[51] Int. Cl.[5] ..... F02P 13/00

[52] U.S. Cl. ..... 123/156; 123/169 EL; 313/131 R

[58] Field of Search ..... 123/156, 162, 169 MG, 123/169 EL, 143 B; 313/131 R, 131 A, 130, 138, 143

[56] References Cited

U.S. PATENT DOCUMENTS

| | | | |
|---|---|---|---|
| 2,262,769 | 11/1941 | King | 313/131 R X |
| 3,349,760 | 10/1967 | Horan | 123/162 |
| 4,061,122 | 12/1977 | Edgar et al. | 123/169 R |
| 4,205,650 | 6/1980 | Szwarebier | 123/146.5 A |
| 4,361,036 | 11/1982 | Levenson | 123/169 R X |
| 4,364,342 | 12/1982 | Asik | 123/143 B |
| 4,491,101 | 1/1985 | Strumbos | 123/169 C |
| 4,774,914 | 10/1988 | Ward | 123/169 EL X |

OTHER PUBLICATIONS

"Lean Burn Engines—Meeting New Challenges with an Old Concept" by Frank Markus, Car and Driver, Feb. 1992, pp. 72–75.

"Experimental Study of a Developing Spark Kernel" by Richard W. Anderson and Myung T. Lim, International Conference on Gas Discharge, 1985.

*Primary Examiner*—Tony M. Argenbright

[57] ABSTRACT

A volume ignition system for internal combustion engines causes ignition processes of fuel by location of a high voltage electrode (1) of a spark plug inside an engine's cylinder. Electrical discharges are created basically from the high voltage electrode (1), during movement of a piston (6) with a connected ring (5), as low voltage electrodes, around the high voltage electrode (1), and to a low voltage electrode (2), connected to the spark plug's metallic body, as sliding discharges. Sliding discharges are created over an insulator (3) along metallization (4), with an extremely large surface area. Discharge plasma is injected into a combustion chamber with flames from inside of the ring (5) and a hollow (7).

4 Claims, 1 Drawing Sheet

VOLUME IGNITION SYSTEM

DESCRIPTION

1. Technical Field

The present invention relates to spark plugs for internal combustion engines.

2. Background Art

A typical internal combustion engine is equipped with a spark plug generally similar to standard design including a body member supporting a pair of electrodes to provide a spark gap. This gap is about 1 mm long with a core diameter of spark about 0.1 mm. Transfer of electrical and heat energy to fuel through this very narrow shell around this spark is not efficient. Processes of ignition, combustion and increase of pressure in an engine cylinder are long.

A plasma jet system with a spark inside of an insulator with longer gap demands a much higher level of voltage for initiation of the spark.

3. Disclosure of Invention

This invention is an effort to improve combustion efficiency, emission characteristics and better fuel economy by increasing spark and ignition areas causing transfer of a higher level of electrical and heat energy into the burned fuel.

Instead of a very small surface of ignited fuel in a typical spark plug there are created volume ignition processes:

- discharges basically from a high voltage electrode mainly to a low voltage electrode connected to a spark plug body as sliding discharges and to other low voltage electrodes as a piston and a ring connected to this piston
- spark plasma injection from a ring connected to a piston into a combustion chamber.

For example sliding discharges may be over a cylindrical surface 15 mm long with a diameter of 10 mm.

Discharges with a diameter over 10 mm are igniting fuel inside the ring with a resulting injection of plasma outside of it, during the piston's and the ring's movement around the high voltage electrode.

Figure 1:
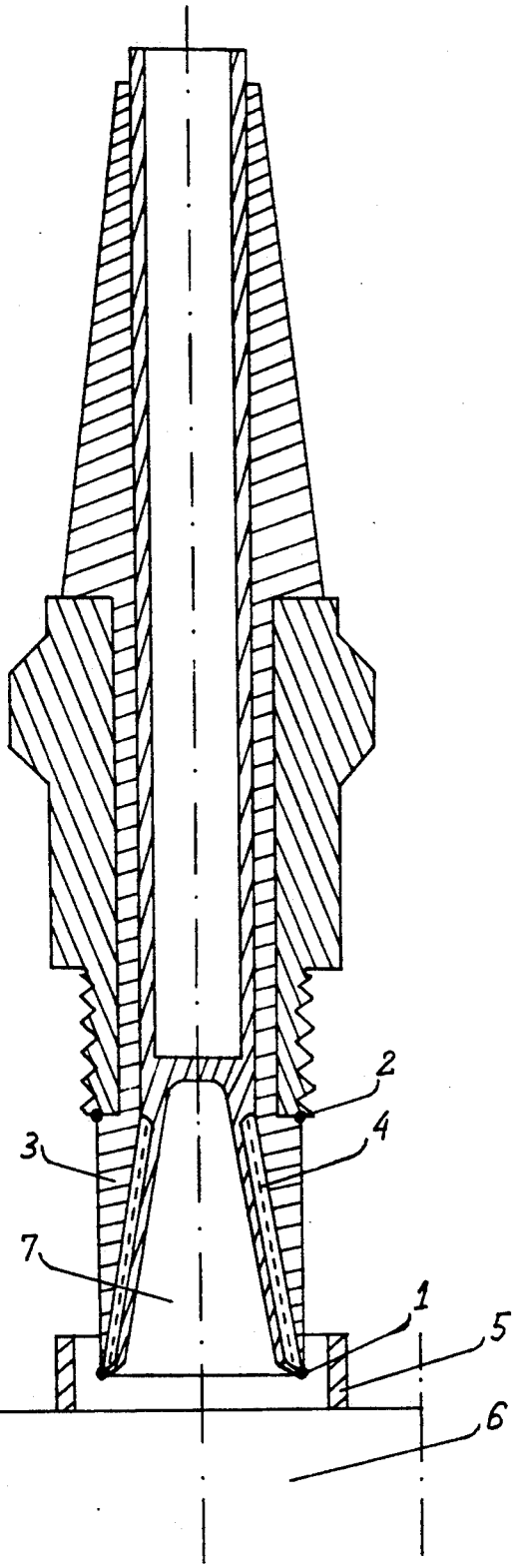
FIG. 1 is a schematic drawing of the invention.

In this figure reference numbers indicate:

1. a high voltage electrode;
2. a low voltage electrode connected to a spark plug's body;
3. a part of insulation with sliding discharges;
4. a metallization of an inner conical surface of a part of insulation with sliding discharges;
5. a ring-a low voltage electrode, connected to a piston, moving around a high voltage electrode;
6. a piston-a low voltage electrode; and
7. a central hollow inside a high voltage electrode.

BEST MODE FOR CARRYING OUT THE INVENTION

Electrical discharges are developing simultaneously basically from a high voltage electrode 1, during movement of a piston 6 with a connected ring 5, as low voltage electrodes, around this high voltage electrode 1, and to a low voltage electrode 2 connected to the spark plug body.

Sliding discharges are created between the high voltage electrode 1 and the low voltage electrode 2 along a metallization 4 of an inner conical surface of an insulator 3, which material has a higher dielectric constant, over a long cylindrical outer surface of the insulator 3, with a large diameter. Those sliding discharges are symmetrical and cause volume ignition of fuel in an upper part of an engine's cylinder.

At the beginning fuel inside the ring 5 and between a central hollow 7 of the high voltage electrode 1 and the piston 6 is ignited by discharges from the high voltage electrode 1, during the piston 6 and ring's movement around this high voltage electrode 1. After it flames spread outside, from inside of the central hollow 7 of the high voltage electrode 1 and the ring 5, causing elongation of discharge plasma. This is another volume ignition process of fuel in a bottom part of the engine cylinder.

The first process of increasing pressure is between the high voltage electrode 1 and the ring 5 and the piston 6 where burning process of fuel is the shortest. The next pressure increase occurs throughout the engine cylinder.

I claim:

1. A volume ignition system for an engine having a cylinder with a piston therein, the ignition system including a spark plug having an elongated, conical high voltage electrode and a low voltage electrode, the electrodes having therebetween an insulator with a cylindrical outer surface and a conical inner surface, said conical inner surface covering said conical high voltage electrode and exposing a portion of said high voltage electrode at an end of said insulator spaced from said low voltage electrode, whereby a large discharge surface is formed on said cylindrical outer surface between said electrodes.

2. A volume ignition system according to claim 1 wherein said elongated, conical high voltage electrode is hollow and said piston includes a ring thereon that surrounds said portion of said high voltage electrode when the piston is at the top of its travel.

3. A volume ignition system according to claim 2 wherein the end of said high voltage electrode and said ring are spaced apart to form a discharge gap.

4. A volume ignition system according to claim 2 wherein said hollow high voltage electrode and said ring are spaced apart to allow burning fuel and plasma to flow from inside said hollow high voltage electrode into a combustion chamber formed by said cylinder and said piston.

* * * * *